US010822127B2

(12) United States Patent
Tai

(10) Patent No.: US 10,822,127 B2
(45) Date of Patent: Nov. 3, 2020

(54) PACKAGING APPARATUS

(71) Applicant: Ishida Co., Ltd., Kyoto (JP)

(72) Inventor: Yuuki Tai, Ritto (JP)

(73) Assignee: Ishida Co., Ltd., Kyoto (JP)

( * ) Notice: Subject to any disclaimer, the term of this patent is extended or adjusted under 35 U.S.C. 154(b) by 207 days.

(21) Appl. No.: 15/546,131

(22) PCT Filed: Jan. 13, 2016

(86) PCT No.: PCT/JP2016/050791
§ 371 (c)(1),
(2) Date: Jul. 25, 2017

(87) PCT Pub. No.: WO2016/121496
PCT Pub. Date: Aug. 4, 2016

(65) Prior Publication Data

US 2018/0002045 A1 Jan. 4, 2018

(30) Foreign Application Priority Data

Jan. 26, 2015 (JP) ..... 2015-012454

(51) Int. Cl.
*B65B 11/10* (2006.01)
*B65B 49/00* (2006.01)
(Continued)

(52) U.S. Cl.
CPC ..... *B65B 11/10* (2013.01); *B65B 11/18* (2013.01); *B65B 11/54* (2013.01); *B65B 49/00* (2013.01); *B65B 49/08* (2013.01)

(58) Field of Classification Search
CPC ..... B65B 11/10; B65B 11/18; B65B 11/54; B65B 49/00; B65B 49/08; B65B 57/00
(Continued)

(56) References Cited

U.S. PATENT DOCUMENTS 3,777,452 A * 12/1973 Koenders ..... B65B 11/54 53/206
3,967,433 A * 7/1976 Bonfiglioli ..... B65B 53/00 53/441
(Continued)

FOREIGN PATENT DOCUMENTS

EP 1 036 738 A1 9/2000
EP 1036738 A1 * 9/2000 ..... B65B 59/003
(Continued)

OTHER PUBLICATIONS

Notification of Transmittal of Translation of the International Preliminary Report on Patentability (Chapter I) and Translation of Written Opinion of the International Searching Authority; PCT/JP2016/050791; dated Aug. 10, 2017.
(Continued)

*Primary Examiner* — Thanh K Truong
*Assistant Examiner* — David G Shutty
(74) *Attorney, Agent, or Firm* — Studebaker & Brackett PC

(57) ABSTRACT

A packaging apparatus includes a first holding unit configured to hold a peripheral edge portion of a film on a front side; a second holding unit configured to hold the peripheral edge portion on a rear side; a lifting unit configured to press an article to be packaged to the film; a folding unit configured to fold the peripheral edge portion on the rear side into an underside of the article to be packaged; and an extruding unit configured to extrude the article to be packaged to the front side. The first holding unit moves to decrease tension of the held film after the peripheral edge portion on the rear side starts to be folded into the underside of the article to be packaged before the extruding unit starts to extrude the article to be packaged from the rear side to the front side.

4 Claims, 9 Drawing Sheets

(51) Int. Cl.

| | |
|---|---|
| ***B65B 11/54*** | (2006.01) |
| ***B65B 49/08*** | (2006.01) |
| ***B65B 11/18*** | (2006.01) |

(58) Field of Classification Search
USPC ..... 53/556
See application file for complete search history.

(56) References Cited

U.S. PATENT DOCUMENTS

| | | | | | |
|---|---|---|---|---|---|
| 4,583,348 | A * | 4/1986 | Treiber | B65B 11/54 | 53/389.3 |
| 4,631,903 | A * | 12/1986 | Takamura | B65B 25/04 | 53/228 |
| 4,674,269 | A * | 6/1987 | Denda | B65B 11/54 | 53/228 |
| 5,157,903 | A * | 10/1992 | Nakashima | B65B 11/54 | 493/476 |
| 5,259,170 | A * | 11/1993 | Tolson | B65B 53/00 | 53/209 |
| 5,528,881 | A * | 6/1996 | Cappi | B65B 11/54 | 53/441 |
| 5,653,093 | A * | 8/1997 | Delledonne | B65B 11/54 | 53/141 |
| 6,718,736 | B2 * | 4/2004 | Oguri | B65B 7/164 | 53/442 |
| 2006/0272283 | A1 * | 12/2006 | Kawanishi | B65B 57/14 | 53/51 |

FOREIGN PATENT DOCUMENTS

| | | | | | |
|---|---|---|---|---|---|
| EP | 1357030 | A1 * | 10/2003 | B65B 11/54 | |
| GB | 949921 | A | 2/1964 | | |
| JP | 06156416 | A * | 6/1994 | B65B 11/20 | |
| JP | 10095402 | A * | 4/1998 | B65B 11/20 | |
| JP | H10-095402 | A | 4/1998 | | |
| JP | 11208611 | A * | 8/1999 | B65B 11/20 | |
| JP | H11-208611 | A | 8/1999 | | |
| JP | 2002-145204 | A | 5/2002 | | |
| JP | 2002-520224 | A | 7/2002 | | |
| JP | 2003-0002304 | * | 1/2003 | B65B 11/20 | |
| JP | 2003-002304 | A | 1/2003 | | |
| JP | 2003-095208 | A | 4/2003 | | |
| JP | 2003095208 | A * | 4/2003 | | |
| JP | 2003-191907 | A | 7/2003 | | |
| JP | 2014-181061 | A | 9/2014 | | |
| JP | 2014-213912 | A | 11/2014 | | |
| JP | 2014213912 | A * | 11/2014 | | |

OTHER PUBLICATIONS

International Search Report issued in PCT/JP2016/050791; dated Apr. 5, 2016.

Extended European Search Report issued by the European Patent Office dated Jul. 11, 2018, which corresponds to EP16743100.6-1016 and is related to U.S. Appl. No. 15/546,131.

A Notice of Allowance, "Decision to Grant a Patent," mailed by the Japanese Patent Office dated Aug. 6, 2019, which corresponds to Japanese Patent Application No. 2015-012454 and is related to U.S. Appl. No. 15/546,131; with English translation.

* cited by examiner

PACKAGING APPARATUS

TECHNICAL FIELD

One aspect of the present invention relates to a packaging apparatus.

BACKGROUND ART

Patent Document 1 describes a packaging apparatus including a lifting mechanism, a film holding mechanism, a film folding mechanism, and a discharge mechanism. In the packaging apparatus described in Patent Document 1, an article to be packaged is pressed to a film held at a peripheral edge portion thereof and is stretched by the film holding mechanism from a lower side of the film by the lifting mechanism. In this state, the peripheral edge portion of the film is folded and overlapped into an underside of the article to be packaged by the film folding mechanism to cause the article to be packaged to be packaged. The packaged article to be packaged is extruded in a horizontal direction toward a discharge port of the packaging apparatus and is discharged by the discharge mechanism. Also, a label on which the price, the weight, and the like of a commodity are printed is stuck on the article to be packaged.

CITATION LIST

Patent Document

Patent Document 1: Japanese Unexamined Patent Publication No. 2003-95208

SUMMARY OF INVENTION

Technical Problem

In a state in which the article to be packaged is pressed to the film, tension is generated in the film. When the peripheral edge portion of the film is folded into the underside of the article to be packaged, holding of the film by the film holding mechanism is released, and the tension decreases. Thus, for example, in a case in which the film is held by a pair of film holding mechanisms arranged to be opposed to each other in a back and forth direction of the packaging apparatus, and when holding by the film holding mechanism on a rear side is released earlier than holding by the film holding mechanism on a front side is, the article to be packaged is pulled to the front side by the film.

In the aforementioned packaging apparatus, there is a case in which, when the article to be packaged is being pulled to the front side, the article to be packaged is pushed from the rear side (upstream side in a discharge direction) toward the front side (downstream side in the discharge direction) by the discharge mechanism. As a result, a posture change of the article to be packaged may be generated, such as the rear side of the article to be packaged rising, and the article to be packaged may fall down during discharging. When the article to be packaged falls down, a failure of label sticking, damage of the commodity, and the like may occur, and appropriate packaging may not be performed.

Thus, one aspect of the present invention aims at providing a packaging apparatus capable of suppressing a posture change of an article to be packaged and packaging the article to be packaged in an appropriate manner.

Solution to Problem

According to one aspect of the present invention, a packaging apparatus packaging an article to be packaged by covering the article to be packaged with a film held at a peripheral edge portion thereof and stretched and overlapping the peripheral edge portion of the film below the article to be packaged, the packaging apparatus includes: a first holding unit configured to hold the peripheral edge portion of the film on a front side; a second holding unit provided to be opposed to the first holding unit and configured to hold the peripheral edge portion of the film on a rear side; a lifting unit configured to carry the article to be packaged and press the article to be packaged to the film held and stretched by the first holding unit and the second holding unit; a folding unit configured to fold the peripheral edge portion of the film on the rear side to which the article to be packaged has been pressed by the lifting unit into an underside of the article to be packaged; and an extruding unit configured to extrude to the front side the article to be packaged having the peripheral edge portion of the film on the rear side folded under the article to be packaged by the folding unit, wherein the first holding unit moves to decrease tension of the held film after the peripheral edge portion of the film on the rear side starts to be folded into the underside of the article to be packaged by the folding unit before the extruding unit starts to extrude the article to be packaged from the rear side to the front side.

In this packaging apparatus, the article to be packaged is pressed by the lifting unit to the film held and stretched by the first holding unit and the second holding unit. As a result, tension is generated in the film. When the peripheral edge portion of the film on the rear side is folded into the underside of the article to be packaged by the folding unit, holding of the peripheral edge portion of the film on the rear side by the second holding unit is released. Thus, a force that causes the article to be packaged to be pulled to the rear side by the film decreases. As a result, the article to be packaged is pulled to the front side by the film Under such circumstances, in this packaging apparatus, the first holding unit moves to decrease tension of the held film after the peripheral edge portion of the film on the rear side starts to be folded into the underside of the article to be packaged by the folding unit before the extruding unit starts to extrude the article to be packaged from the rear side to the front side. This prevents the article to be packaged from being pushed from the rear side toward the front side by the extruding unit in a state in which the article to be packaged is pulled to the front side by the film. Consequently, a posture change of the article to be packaged is suppressed, such as the rear side of the article to be packaged rising, and the article to be packaged can be packaged in an appropriate manner.

In the packaging apparatus according to one aspect of the present invention, the article to be packaged is a commodity placed on a tray. A weighted center of the commodity may be located at a region to the front with respect to a center of the tray or a region above a height of the tray. According to this packaging apparatus, even in a case in which the article to be packaged is one whose rear side is particularly easy to rise, such a posture change of the article to be packaged can be suppressed.

In the packaging apparatus according to one aspect of the present invention, the first holding unit may move to the rear side after the peripheral edge portion of the film on the rear side starts to be folded into the underside of the article to be packaged by the folding unit before the extruding unit starts to extrude the article to be packaged from the rear side to the front side. Accordingly, the first holding unit moves to the rear side and approaches the article to be packaged to enable tension of the film held by the first holding unit to be decreased easily and reliably.

Advantageous Effects of Invention

According to one aspect of the present invention, it is possible to provide a packaging apparatus capable of suppressing a posture change of an article to be packaged and packaging the article to be packaged in an appropriate manner.

DESCRIPTION OF EMBODIMENTS

Hereinafter, a preferred embodiment of one aspect of the present invention is described in detail with reference to the attached drawings. Note that in descriptions of the drawings, the same or equivalent element is denoted by the same reference sign, and a duplicated description is omitted.

Figure 1:
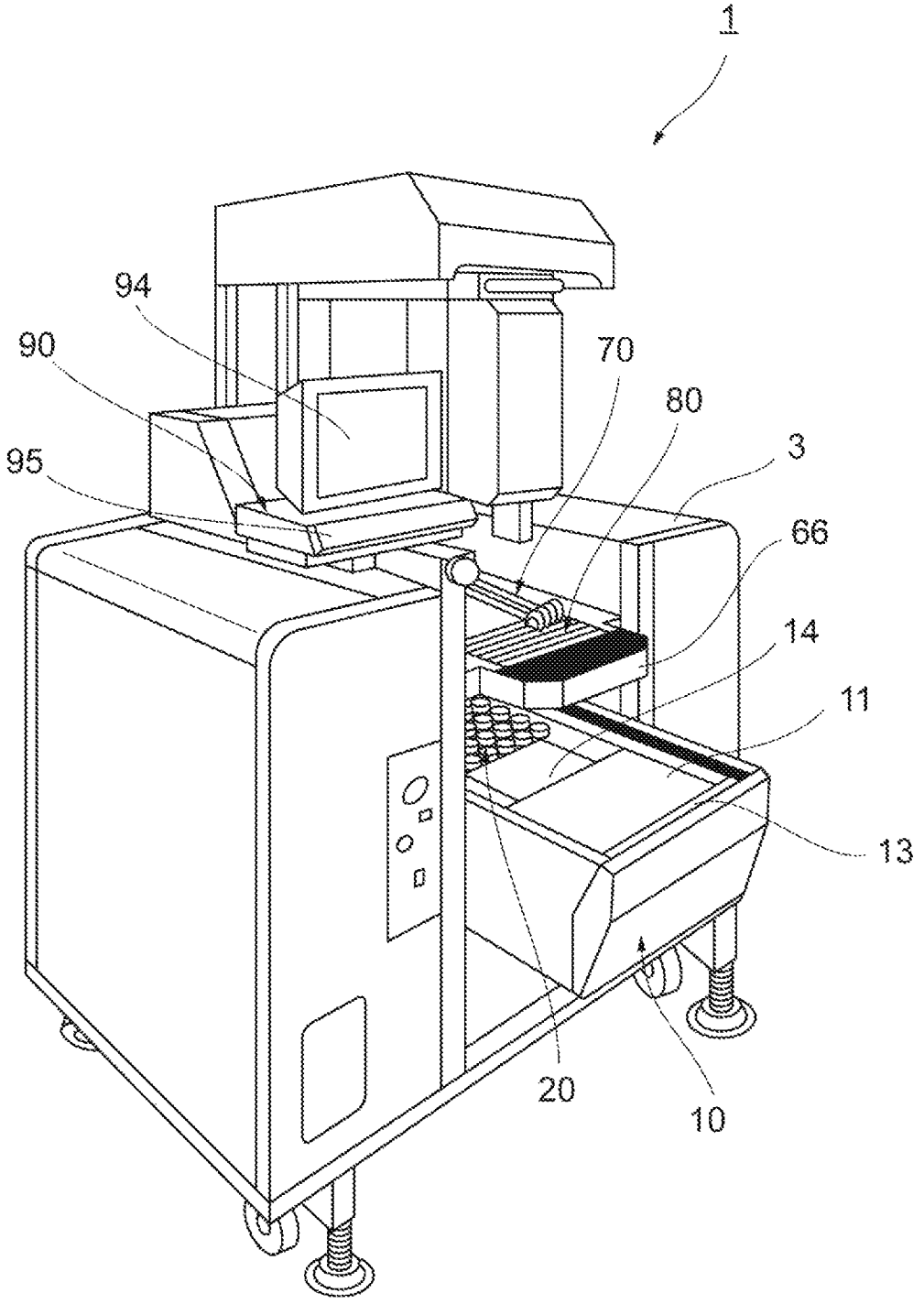
FIG. 1 is a perspective view illustrating an external appearance of a packaging apparatus according to one embodiment.
Figure 2:
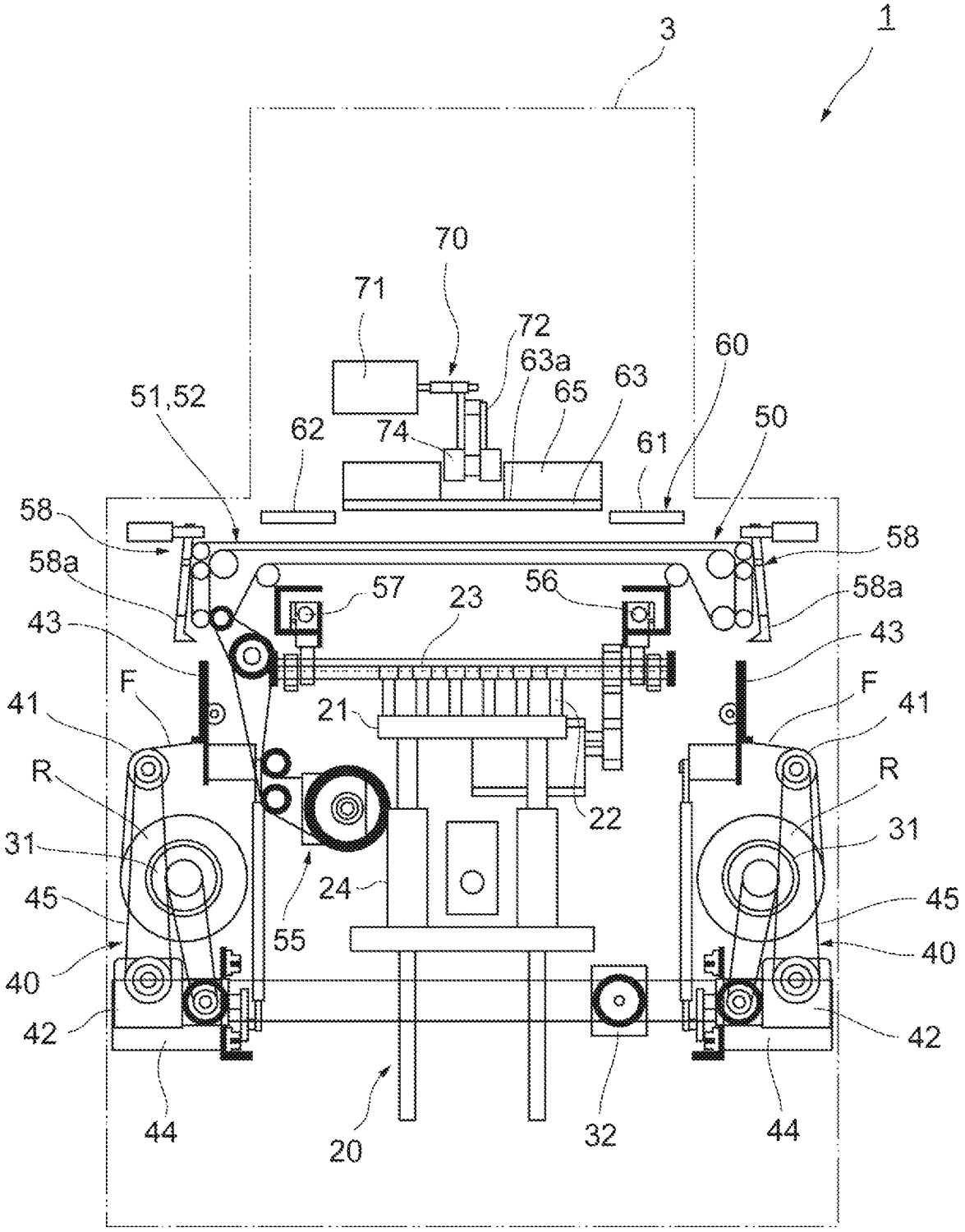
FIG. 2 is a front view illustrating an internal configuration of the packaging apparatus.
Figure 3:
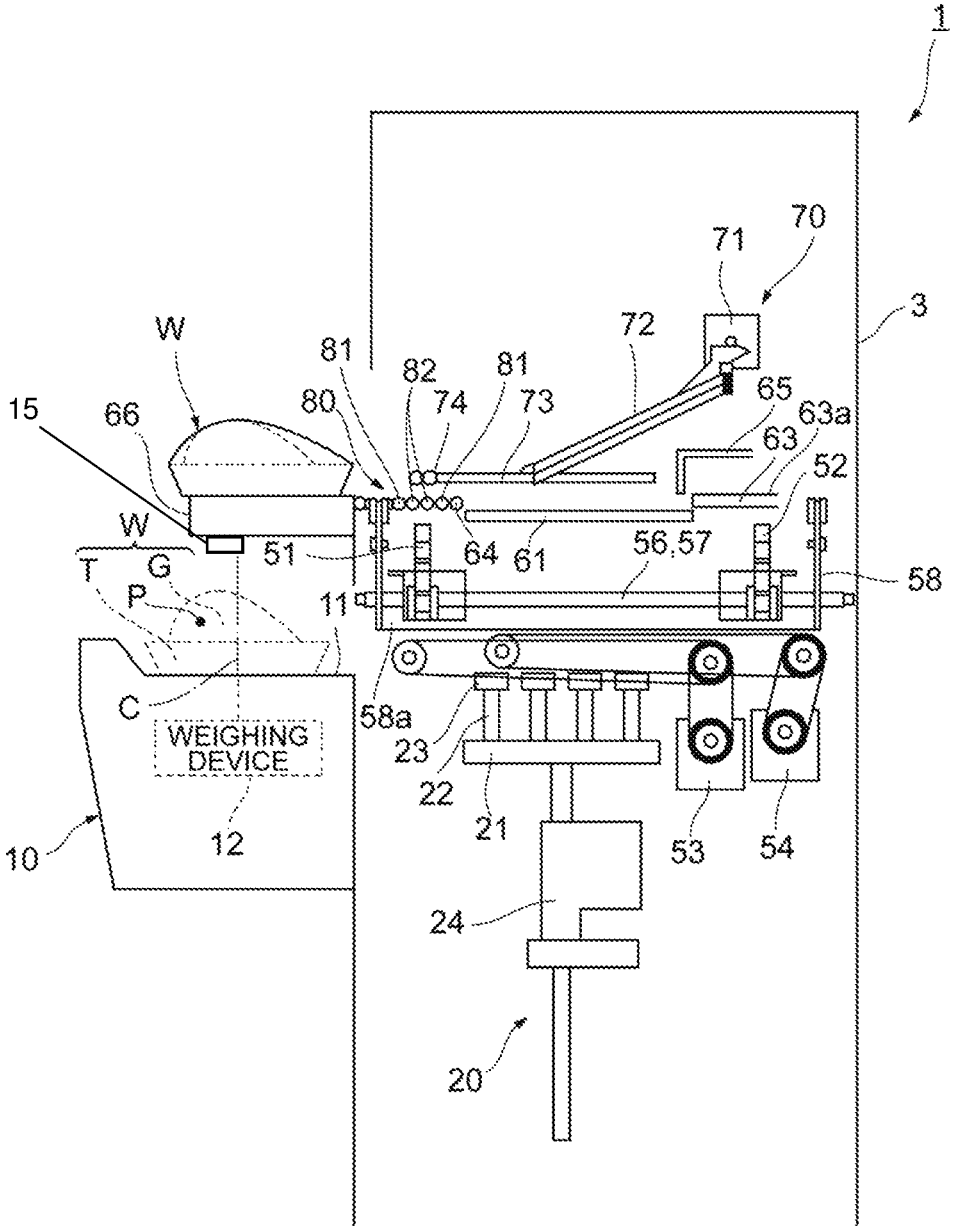
FIG. 3 is a side view illustrating the internal configuration of the packaging apparatus.
Figure 4:
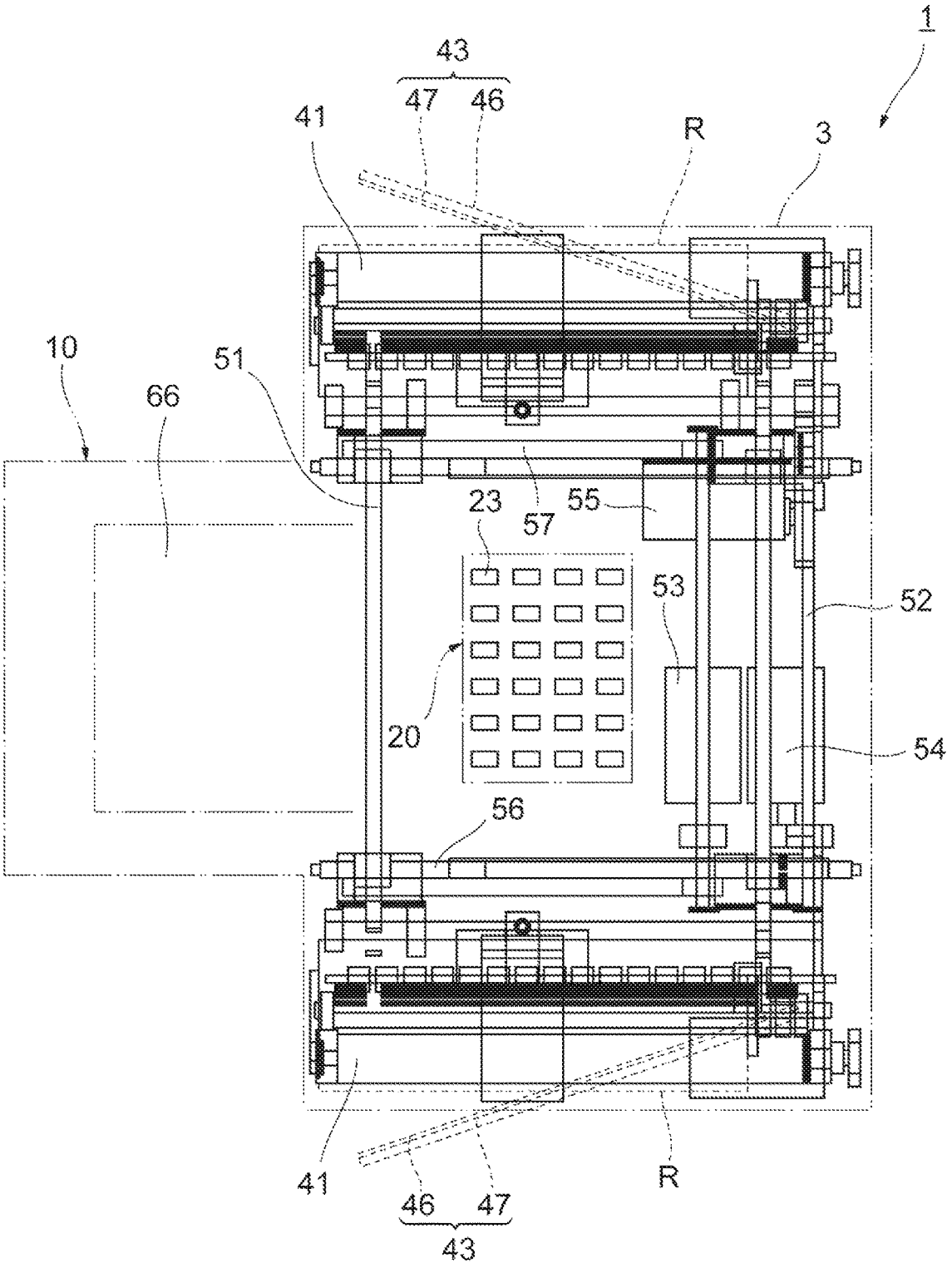
FIG. 4 is a plan view illustrating the internal configuration of the packaging apparatus.
Figure 5:
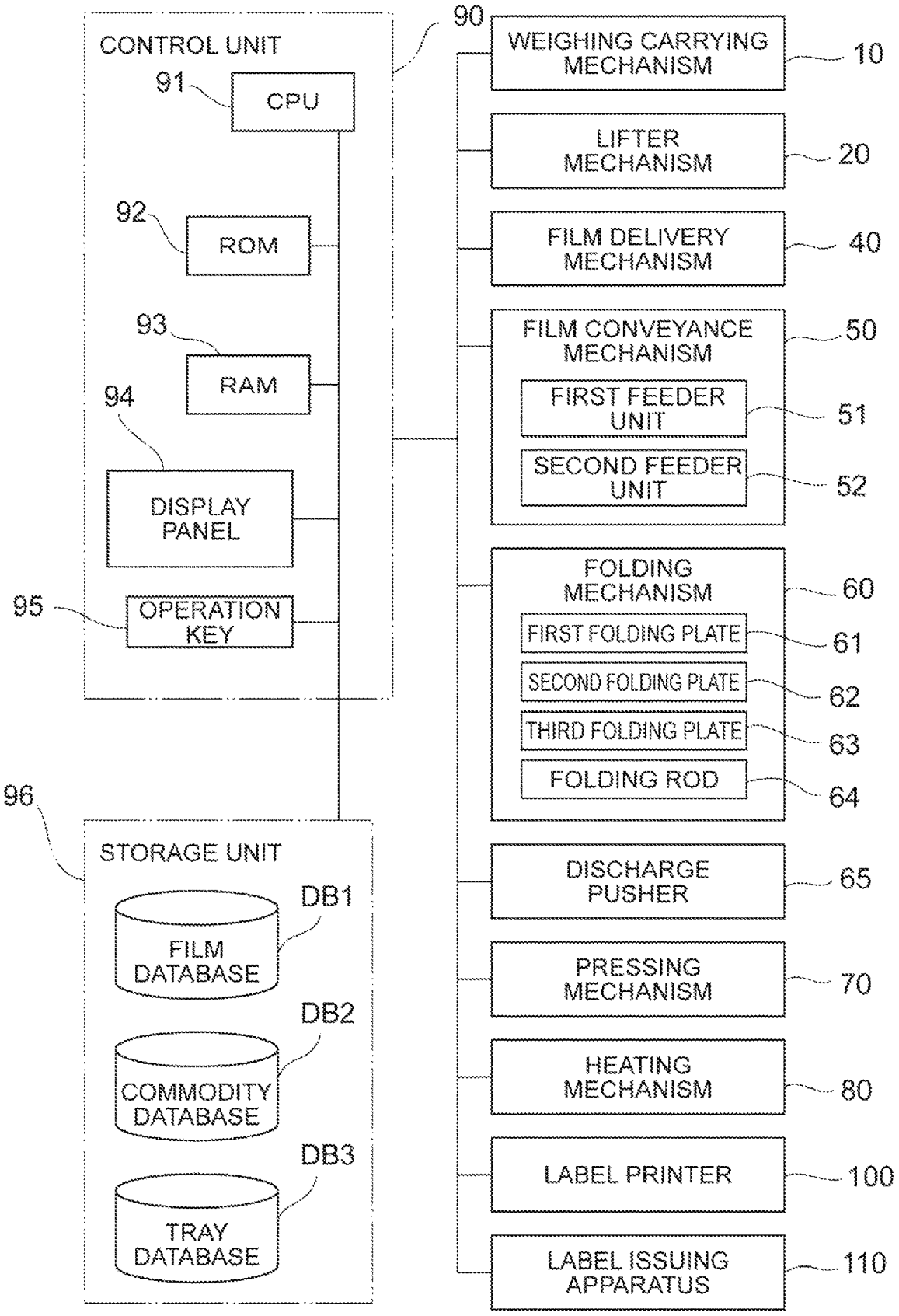
FIG. 5 is a block diagram illustrating a configuration of the packaging apparatus.

FIG. 1 is a perspective view illustrating an external appearance of a packaging apparatus according to one embodiment. FIG. 2 is a front view illustrating an internal configuration of the packaging apparatus illustrated in FIG. 1. FIG. 3 is a side view illustrating the internal configuration of the packaging apparatus. FIG. 4 is a plan view illustrating the internal configuration of the packaging apparatus. FIG. 5 is a block diagram illustrating a configuration of the packaging apparatus. In descriptions below, a vertical direction in FIG. 2 is referred to as a "vertical direction" of a packaging apparatus 1, a right and left direction therein is referred to as a "right and left direction" of the packaging apparatus 1, and a right and left direction in FIG. 3 is referred to as a "back and forth direction" of the packaging apparatus 1.

The packaging apparatus 1 illustrated in FIGS. 1 to 5 is an apparatus that stretch packages an article to be packaged W. The packaging apparatus 1 pushes up the article to be packaged W, which is a commodity G such as perishable foodstuff placed on a tray T, against a stretch film F as a stretched packaging material from below. The packaging apparatus 1 overlaps (folds) a peripheral edge portion of the stretch film F below the tray T. The packaging apparatus 1 is an apparatus that stretch packages the article to be packaged W by heat sealing the overlapped portion. In addition to a film packaging function, the packaging apparatus 1 according to this embodiment is also provided with a weighing function and a pricing function by sticking a label. In the following description, an embodiment of packaging the article to be packaged W, which is the commodity G placed on the tray T, is described. In this embodiment, the length of the tray T in the back and forth direction is approximately 100 mm. A weighted center P of the commodity G is located at a region to the front with respect to a center C of the tray T and above the height of the tray T (see FIG. 3).

The packaging apparatus 1 is provided with a weighing carrying mechanism 10, a lifter mechanism (lifting unit) 20, a roll supporting mechanism 30, a film delivery mechanism 40, a film conveyance mechanism 50, a folding mechanism 60, a pressing mechanism 70, a heating mechanism (heating unit) 80, a control unit 90, a label printer 100, and a label issuing apparatus 110.

[Weighing Carrying Mechanism]

The weighing carrying mechanism 10 weighs the commodity G of the article to be packaged W. The weighing carrying mechanism 10 carries the article to be packaged W in the packaging apparatus 1. The weighing carrying mechanism 10 is provided to a central part in the front of a main body 3 of the packaging apparatus 1. The weighing carrying mechanism 10 has a weighing device 12, an extrusion bar 13, a conveyer 14, and a camera 15. The weighing device 12 weighs weight of the article to be packaged W placed on a weighing tray 11. The extrusion bar 13 extrudes the article to be packaged W toward the lifter mechanism 20. The conveyer 14 conveys the article to be packaged W that has been extruded by the extrusion bar 13 to the lifter mechanism 20. The camera 15 images the article to be packaged W. Operation of the weighing carrying mechanism 10 is controlled by a control unit 90.

The weighing device 12 outputs information on the weight of the article to be packaged W that has been weighed to the control unit 90. The extrusion bar 13 is provided on the weighing tray 11. The extrusion bar 13 extends along a width direction of the weighing tray 11. The extrusion bar 13 is positioned at a front end of the weighing tray 11 as an initial position. The extrusion bar 13 is provided to be movable in the back and forth direction by a driving device, which is not illustrated. The conveyer 14 is provided on a rear end side of the weighing tray 11. The conveyer 14 is provided to be movable in the right and left direction by the driving device, which is not illustrated. The camera 15 images the article to be packaged W placed on the weighing tray 11. The camera 15 outputs image information that has been imaged to the control unit 90.

As illustrated in FIG. 3, when the article to be packaged W is placed on the weighing device 12, the weighing carrying mechanism 10 weighs the weight of the article to be packaged W by the weighing device 12. The weighing carrying mechanism 10 images the article to be packaged W by the camera 15 arranged above the weighing tray 11. The weighing carrying mechanism 10 images the article to be packaged W by the camera 15. Then, the weighing carrying mechanism 10 extrudes the article to be packaged W to the side of the lifter mechanism 20 by the extrusion bar 13. Then, the weighing carrying mechanism 10 conveys the article to be packaged W to the lifter mechanism 20 by the conveyer 14.

The weighing carrying mechanism 10 has a centering mechanism for the article to be packaged W. Specifically, the weighing carrying mechanism 10 performs centering of the article to be packaged W by operating the conveyer 14 corresponding to a acquired position of the article to be packaged W based on the image that has been imaged by the camera 15. In detail, the weighing carrying mechanism 10 moves a position of the conveyer 14 in the right and left direction corresponding to the position of the article to be packaged W on the weighing tray 11. The weighing carrying mechanism 10 positions the conveyer 14 in the front (center) of the article to be packaged W, which is extruded by the extrusion bar 13. When the article to be packaged W is positioned on the conveyer 14, the weighing carrying mechanism 10 moves the position of the conveyer 14 to the central part, which is an initial position thereof. The weighing carrying mechanism 10 subsequently conveys the article to be packaged W to the lifter mechanism 20 by the conveyer 14. Accordingly, even in a case where the article to be packaged W is placed in a position other than the central part of the weighing tray 11, the weighing carrying mechanism 10 can deliver the article to be packaged W always in the same position relative to the lifter mechanism 20.

[Lifter Mechanism]

The lifter mechanism 20 pushes the article to be packaged W upward. The lifter mechanism 20 is provided on a rear side of the weighing carrying mechanism 10. When the lifter mechanism 20 carries the article to be packaged W from the weighing carrying mechanism 10, the lifter mechanism 20 pushes the article to be packaged W upward. That is, the lifter mechanism 20 is a mechanism on which the article to be packaged W is placed and presses the article to be packaged W to the stretch film F held and stretched by a first feeder unit 51 and a second feeder unit 52 described below. The lifter mechanism 20 has a support base 21, a plurality of support bars 22, a plurality of support members 23, and an electric ball screw mechanism 24. The plurality of support bars 22 is fixed on the support base 21. Each support member 23 is turnably provided to an upper end of each of the support bars 22. The support members 23 support a bottom face of the tray T. The electric ball screw mechanism 24 moves the support base 21 up and down. Operation of the lifter mechanism 20 is controlled by the control unit 90.

In the lifter mechanism 20, due to moving of the support base 21 by the electric ball screw mechanism 24, the support bars 22 and the support members 23 move in the vertical direction. Each of the support bars 22 is provided with a hinge (not illustrated), which bends back and forth and to the right and left, at a central portion thereof. Accordingly, when a first folding plate 61, a second folding plate 62, and a third folding plate 63, which are described below, enter into the underneath of the tray T, each of the support bars 22 temporarily falls down.

[Roll Supporting Mechanism]

The roll supporting mechanism 30 holds a film roll R. In this embodiment, the roll supporting mechanisms 30 are provided to both sides of the main body 3. That is, two film rolls R may be used on the packaging apparatus 1. Around the film roll R, the stretch film F having elasticity is wrapped multiple times. The stretch film F of one of the film rolls R may be of the same type as or a different type from the stretch film F of the other of the film rolls R. In this embodiment, the two film rolls R are of different types and have different width dimensions of the stretch film F. Each of the stretch films F may be, for example, polyolefin, vinyl chloride, or the like.

The roll supporting mechanism 30 has a roll bar 31. The roll bar 31 is inserted through the film roll R and holds the film roll R with a holder and the like. Each of the roll bars 31 is rotatably supported to the main body 3 and is driven by one film roll drive motor 32. The film roll drive motor 32 is capable of normal and reverse rotation. The film roll drive motor 32 drives one of the roll bars 31 during the normal rotation or drives the other of the roll bars 31 during the reverse rotation.

[Film Delivery Mechanism]

The film delivery mechanism 40 passes the stretch film F, which has been drawn out from the film roll R, to a first feeder unit 51 and a second feeder unit 52 of the film conveyance mechanism 50, which is described below. As illustrated in FIG. 2, the film delivery mechanism 40 has a feeding roller 41, a feeding motor 42, a film insertion plate unit 43, and a film insertion plate drive motor 44. The feeding motor 42 drives the feeding roller 41. The film insertion plate drive motor 44 moves the film insertion plate unit 43 up and down.

The feeding roller 41 is a roller that feeds the stretch film F from the film roll R. The feeding roller 41 extends along a width direction of the film roll R (back and forth direction of the packaging apparatus 1). The feeding roller 41 is positioned above the roll supporting mechanism 30 supporting the film roll R. The feeding roller 41 is arranged outside of the roll bar 31 in the right and left direction. The feeding roller 41 is coupled to the feeding motor 42 through a belt 45, and it is rotated by operation of the feeding motor 42.

The film insertion plate unit 43 is constituted of two plate members 46 and 47. As illustrated in FIG. 2, the film insertion plate unit 43 is arranged above the film roll R, which is supported by the roll supporting mechanism 30.

The film insertion plate drive motor 44 moves the film insertion plate unit 43 up and down. The film insertion plate drive motor 44 moves the film insertion plate unit 43 up and down through a link mechanism. By moving the film insertion plate unit 43 by the film insertion plate drive motor 44, the film delivery mechanism 40 passes the stretch film F of the film roll R, which is supported by the roll supporting mechanism 30, to the film conveyance mechanism 50. Operation of the film insertion plate drive motor 44 is controlled by the control unit 90.

[Film Conveyance Mechanism]

The film conveyance mechanism 50 receives the stretch film F that has been fed from the film roll R by the film delivery mechanism 40. The film conveyance mechanism 50 conveys the stretch film F to a central part of the lifter mechanism 20. The film conveyance mechanism 50 holds the stretch film F in a stretched manner. The film conveyance mechanism 50 has the first feeder unit (first holding unit) 51, the second feeder unit (second holding unit) 52, a first feeder move unit 53, a second feeder move unit 54, and a feeder driving unit 55.

As illustrated in FIG. 3, the first feeder unit 51 and the second feeder unit 52 are facingly arranged. The first feeder unit 51 is arranged to a front side of the packaging apparatus 1. The first feeder unit 51 holds the peripheral edge portion of the stretch film F on the rear side. The second feeder unit 52 is arranged to a rear side of the packaging apparatus 1. The second feeder unit 52 holds the peripheral edge portion of the stretch film F on the front side. The first feeder unit 51 and the second feeder unit 52 sandwich both sides of the stretch film F being transversely fed with upper and lower belts, and the stretch film F is conveyed by operation of the feeder driving unit 55.

Each of the first feeder unit 51 and the second feeder unit 52 is supported by slide shafts 56 and 57 to be freely movable. The slide shafts 56 and 57 extend along a width direction of the stretch film F (back and forth direction of the packaging apparatus 1). The first feeder move unit 53 moves the first feeder unit 51 along an extending direction of the slide shafts 56 and 57 (width direction of the stretch film F). The second feeder move unit 54 moves the second feeder unit 52 along the extending direction of the slide shafts 56 and 57.

Each of the first feeder unit 51 and the second feeder unit 52 has a plurality of clamps (not illustrated). The plurality of clamps operates by a solenoid and performs holding of the stretch film F as well as releasing of the holding thereof.

The film conveyance mechanism 50 has a cutter portion 58. The cutter portion 58 cuts the stretch film F. Specifically, the cutter portion 58 cuts the stretch film F after the stretch film F, which has been passed from the film delivery mechanism 40 to the film conveyance mechanism 50, is conveyed for a predetermined amount in the film conveyance mechanism 50. The cutter portion 58 cuts the stretch film F between the film delivery mechanism 40 and the film conveyance mechanism 50. The cutter portion 58 has a cutting blade 58*a*, which is larger than a width dimension of the stretch film F. The cutter portion 58 cuts the stretch film F by moving the cutting blade 58*a* by an actuator. Operation of the cutter portion 58 is controlled by the control unit 90.

As illustrated in FIG. 2, two cutter portions 58 are provided. One of the cutter portions 58 cuts the stretch film F fed from the film roll R on the right side. The other of the cutter portions 58 cuts the stretch film F fed from the film roll R on the left side.

[Folding Mechanism]

The folding mechanism 60 folds the stretch film F into an underside of the tray T. The folding mechanism 60 overlaps the peripheral edge portion of the stretch film F below the tray T. As illustrated in FIGS. 2 and 3, the folding mechanism 60 has the first folding plate 61, the second folding plate 62, and a third folding plate (folding unit) 63, and a folding rod 64.

The first folding plate 61 and the second folding plate 62 fold both end portions of the stretch film F in a conveyance direction into the underside of the tray T. As illustrated in FIG. 2, the first folding plate 61 and the second folding plate 62 are provided in the same height position. The first folding plate 61 and the second folding plate 62 are provided to be horizontally movable by a motor and a timing belt, which are not illustrated. Operation of the motor is controlled by the control unit 90.

The third folding plate 63 folds the peripheral edge portion of the rear-side stretch film F to which the article to be packaged W has been pressed by the lifter mechanism 20 into the underside of the article to be packaged W. The third folding plate 63 is positioned above the first folding plate 61 and the second folding plate 62. The third folding plate 63 is provided to be horizontally movable by the motor and the timing belt, which are not illustrated. The operation of the motor is controlled by the control unit 90.

The folding rod 64 folds the side portion of the stretch film F on a side of the first feeder unit 51 into the underside of the tray T. The folding rod 64 is arranged so as to fold the side portion thereof into the underside of the tray T when the tray T is discharged by a discharge pusher (extruding unit) 65 that extrudes the tray T toward a discharge table 66.

As illustrated in FIG. 2, the discharge pusher 65 is divided into two, to the right and to the left, so as to avoid contacting a pressing plate 73 and a pressing roller 74 of a pressing mechanism 70 described below. The discharge pusher 65 horizontally moves from the right side to the left side in FIG. 3 (toward the rear to the front of the packaging apparatus 1). The discharge pusher 65 extrudes to the front side the article to be packaged W having the peripheral edge portion of the rear-side stretch film F folded under the article to be packaged W by the third folding plate 63. Thus, the rear side of the packaging apparatus 1 corresponds to an upstream side in a discharge direction, and the front side of the packaging apparatus 1 corresponds to a downstream side in the discharge direction.

[Pressing Mechanism]

The pressing mechanism 70 applies an external force to the article to be packaged W positioned on the heating roller 82 described below. The pressing mechanism 70 applies the external force to the article to be packaged W such that contact pressure between the heating roller 82 and the article to be packaged W becomes large. The pressing mechanism 70 has a servo motor 71, an arm 72 connected to the servo motor 71, the pressing plate 73 connected to the arm 72, and the plurality of pressing rollers 74 provided to the pressing plate 73.

The arm 72 is connected to the servo motor 71 at one end thereof. The arm 72 swings interlockingly with operation of the servo motor 71. The pressing plate 73 is connected to the other end of the arm 72. The pressing plate 73 is attached to the aim 72 so as to maintain it to be horizontal. The pressing roller 74 is provided to a front end of the pressing plate 73. The pressing roller 74 is, for example, a spongy roller containing silicon as a raw material. The pressing roller 74 is rotatably attached to the pressing plate 73. In the pressing mechanism 70, when the arm 72 is swung by drive of the servo motor 71, accompanied by this, height position of the pressing plate 73 is changed.

The pressing mechanism 70 presses the article to be packaged W against the heating roller 82. At the article to be packaged W, while the tray T is being extruded to the discharge table 66 by the discharge pusher 65, the stretch film F is folded into the underside of the tray T. When this stretch film F is heat sealed by a heating mechanism 80, the pressing mechanism 70 presses the article to be packaged W against the heating roller 82. Accordingly, the contact pressure between the heating roller 82 and the article to be packaged W becomes large. A force with which the pressing mechanism 70 presses the article to be packaged W and duration of the pressing mechanism 70 pressing the article to be packaged W are adjusted by the drive of the servo motor 71. The operation of the servo motor 71 is controlled by the control unit 90.

When the article to be packaged W is pushed up by the lifter mechanism 20 and is stopped, the pressing mechanism 70 presses the article to be packaged W with deadweight of the pressing plate 73 and the like. At this time, the servo motor 71 does not drive.

[Heating Mechanism]

The heating mechanism 80 heat seals the stretch film F that is overlapped below the tray T. The heating mechanism 80 has a plurality of conveyance rollers 81, and the plurality of heating rollers 82. The heating mechanism 80 heat seals the article to be packaged W that is extruded by the discharge pusher 65 while conveying it by the conveyance rollers 81 and the heating rollers 82.

The plurality of conveyance rollers 81 is arranged before and after the heating rollers 82. The plurality of conveyance rollers 81, for example, is arranged so as to sandwich the heating rollers 82. In this embodiment, two heating rollers 82 are arranged. The conveyance rollers 81 and the heating rollers 82 are rotatably supported by a support member, which is not illustrated.

The heating roller 82 has a cylindrical shape. The heating roller 82 has a cylindrical heater 83 inserted therein. The heater 83 is an electric cartridge heater. The heater 83 is not in contact with the heating roller 82. Accordingly, the heater 83 is not rotated with the heating roller 82.

[Control Unit]

The control unit 90 controls operation of the packaging apparatus 1. The control unit 90 is a computer constituted of a CPU 91, a ROM 92, and a RAM 93. The control unit 90 is connected to each unit constituting the packaging apparatus 1. In the ROM 92, control program for controlling the packaging apparatus 1 is stored. Based on the control program stored in the ROM 92, the CPU 91 controls the packaging apparatus 1. The RAM 93 functions as a work memory used when the control program stored in the ROM 92 is executed by the CPU 91. The control unit 90 also has a display panel 94, and an operation key 95. The display panel 94 is a touch panel type display, and an operation button is arranged on the panel.

The control unit 90 controls operation of each of the above-described mechanisms. Based on a signal indicating weight of the commodity G weighed by the weighing carrying mechanism 10, the control unit 90 performs calculation and the like of a price of the commodity G. The control unit 90 controls operation of the label printer 100 that prints the weight, the price, and the like of the commodity G on a label as well as operation of the label issuing apparatus 110.

The storage unit 96 is connected to the control unit 90. The storage unit 96 stores a film database DB1, a commodity database DB2, and a tray database DB3. The film database DB1 stores data related to characteristics of multiple types of stretch films F for each type of the stretch film F. Specifically, the film database DB1 stores the data such as thickness, a material, and a film width of the stretch film F for each film number.

In the commodity database DB2, data related to unit price data of the commodity G and characteristics of the commodity G is stored for each type of the commodity G Specifically, in the commodity database DB2, for each call out number of the commodity G, there is stored data of a shape and the like of the commodity G, data of a unit price of the commodity G, and data of a tray number of one or a plurality of trays T to be used. In the tray database DB3, data related to characteristics of the tray T is stored for each type of the tray T. In the tray database DB3, for each of the tray numbers, there is stored the data such as dimensions, a shape, a material, a tare weight (tray weight, or tray weight added with film weight), and the like of the tray T.

Each of the databases DB1, DB2, and DB3 may be rewritten with updated data. The data may be updated by inputting from the display panel 94, the operation key 95, or the like or by receiving data forwarded from an external device, and the like.

[Label Printer]

The label printer 100 prints the commodity information, the weight of the commodity G, the price, and the like on a label. Based on instruction of the control unit 90, the label printer 100 prints and outputs the label.

[Label Issuing Apparatus]

The label issuing apparatus 110 sticks the label on the stretch film F that is packaged on the article to be packaged W. The label issuing apparatus 110 receives the label outputted from the label printer 100. While the article to be packaged W is extruded toward the discharge table 66 by the discharge pusher 65, the label issuing apparatus 110 sticks the label on the article to be packaged W.

[Operation of Packaging Apparatus]

The operation of the packaging apparatus 1 is described with reference to FIGS. 6A, 6B, 7A, 7B, 8A, 8B, 9A and 9B. FIGS. 6A to 9B are views illustrating the operation of the packaging apparatus. As illustrated in FIGS. 6A to 9B, in the packaging apparatus 1, a posture change of the article to be packaged W when the article to be packaged W is extruded by the discharge pusher 65 is suppressed.

Figure 6B:
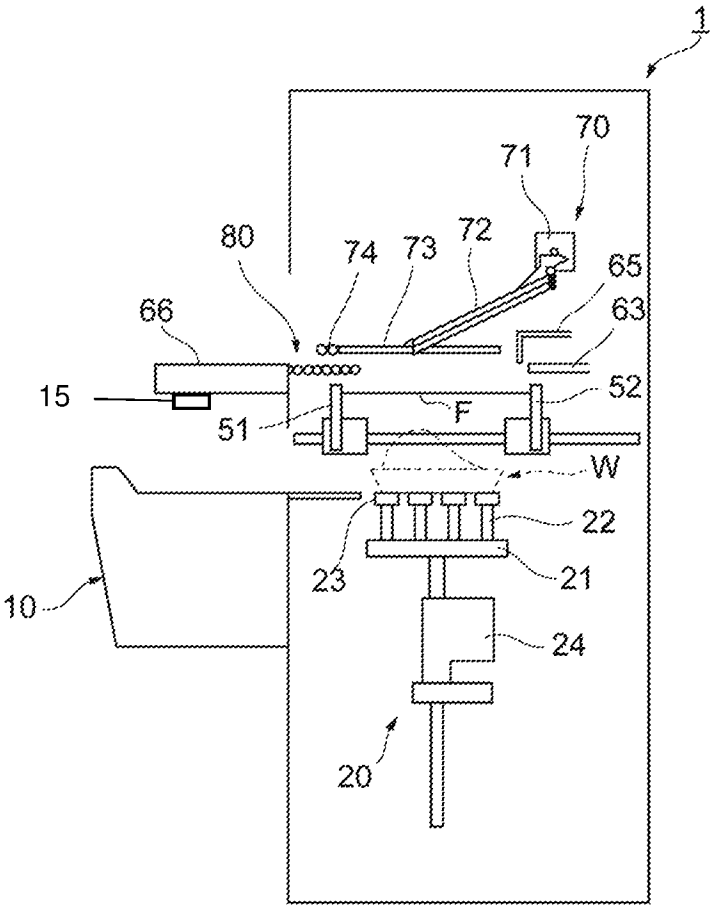
FIG. 6B is a view illustrating operation of the packaging apparatus.
Figure 6A:
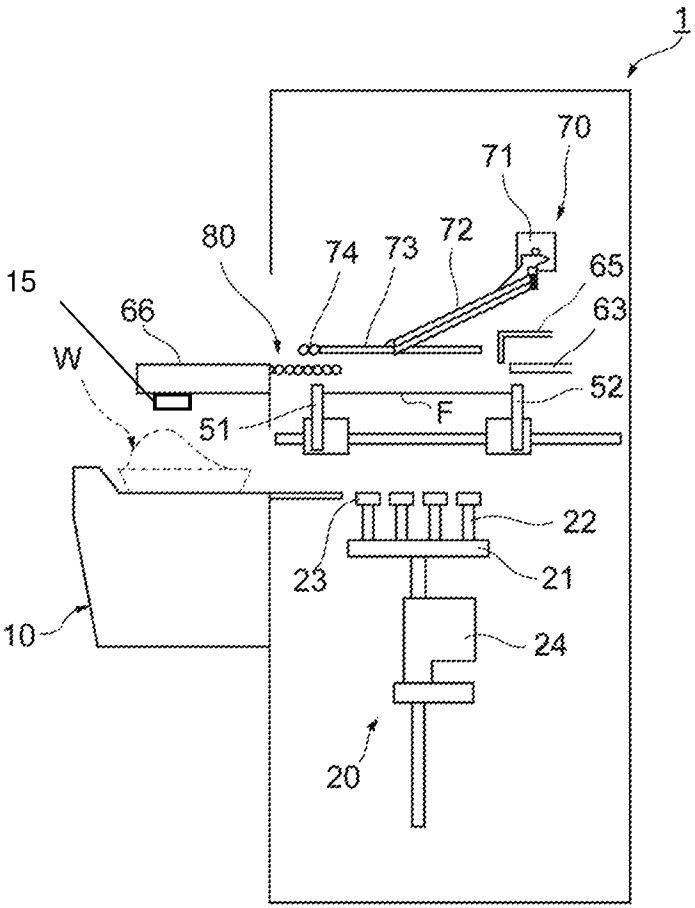
FIG. 6A is a view illustrating operation of the packaging apparatus.

As illustrated in FIG. 6A and FIG. 6B, in the packaging apparatus 1, when the article to be packaged W is placed on the weighing tray 11, the weighing device 12 weighs the article to be packaged W, and the camera 15 images the article to be packaged W. In the packaging apparatus 1, the weighing carrying mechanism 10 conveys the article to be packaged W to the lifter mechanism 20. The stretch film F is passed from the film roll R to the film conveyance mechanism 50 by the film delivery mechanism 40. The stretch film F is cut by the cutting blade 58*a* of the cutter portion 58, and is formed into one sheet of rectangular stretch film F. The stretch film F is delivered above the lifter mechanism 20 by both feeder units 51 and 52. Then, above the lifter mechanism 20, the stretch film F is in a state where a periphery of the stretch film F is strongly held by function of each clamp. In the following description, the front-side stretch film F means a portion of the stretch film F corresponding to the front side of the rectangular stretch film F that has been delivered above the lifter mechanism 20, the rear-side stretch film F means a portion of the stretch film F corresponding to the rear side of the rectangular stretch film F that has been delivered above the lifter mechanism 20, and the right-side or left-side stretch film F means a portion of the stretch film F corresponding to the right or left side of the rectangular stretch film F that has been delivered above the lifter mechanism 20.

Figure 7B:
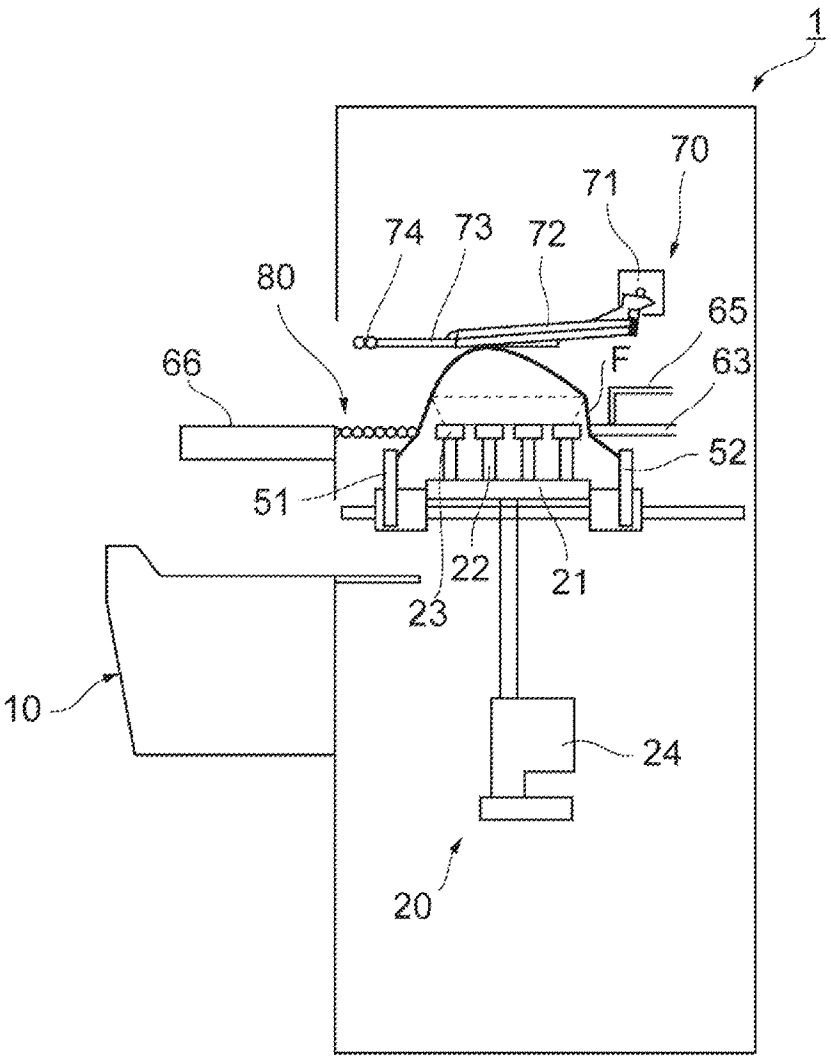
FIG. 7B is a view illustrating operation of the packaging apparatus.
Figure 7A:
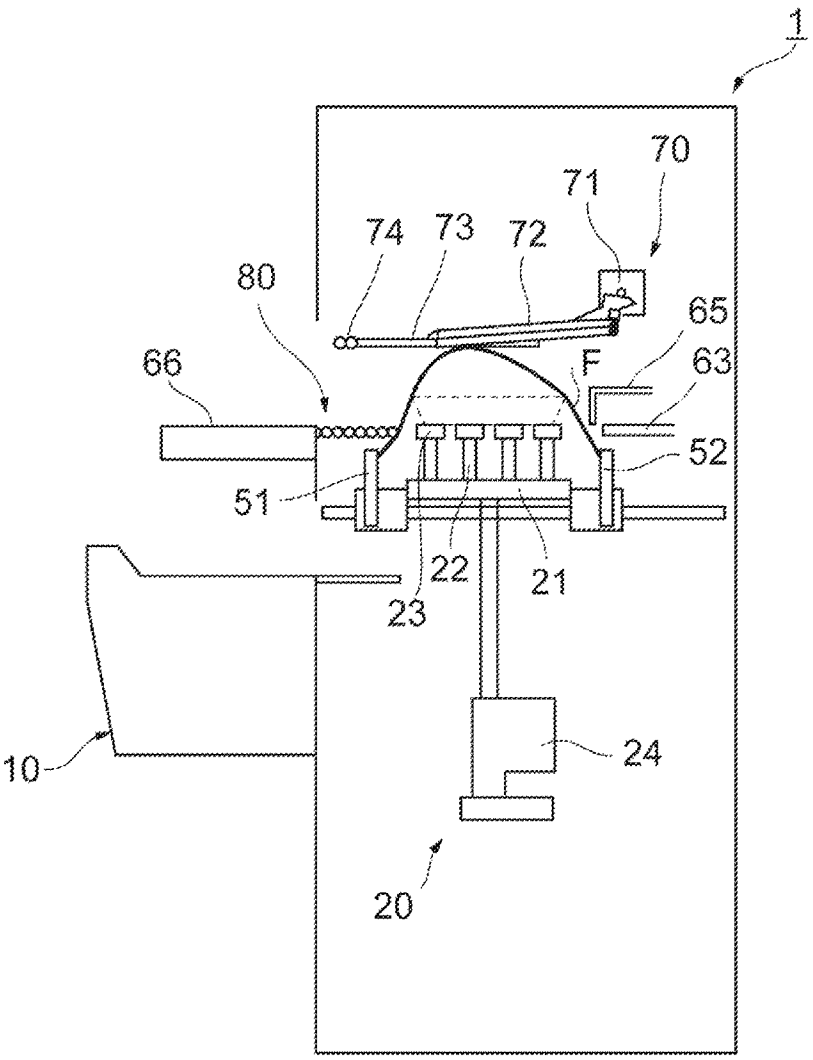
FIG. 7A is a view illustrating operation of the packaging apparatus.

As illustrated in FIG. 7A, the article to be packaged W is pushed by the lifter mechanism 20 toward the stretch film F held and stretched by the first feeder unit 51 and the second feeder unit 52. Then, the stretch film F being strongly held at the periphery thereof extends so as to cover a top portion of the commodity G and the tray T. When the article to be packaged W is pushed toward the stretch film F, tension is generated in the stretch film F. In the front-side stretch film F, tension (hereinafter referred to as front tension) is generated between a portion thereof held by the first feeder unit 51 and a contact portion thereof with the article to be packaged W. In the rear-side stretch film F, tension (hereinafter referred to as rear tension) is generated between a portion thereof held by the second feeder unit 52 and a contact portion thereof with the article to be packaged W. The front tension and the rear tension are almost balanced. Thus, at this stage, the article to be packaged W is not pulled to the front side or the rear side by the stretch film F, and posture of the article to be packaged W is not changed. Meanwhile, the discharge pusher 65 and the third folding plate 63 are at a distance from the article to be packaged W when stopped.

Subsequently, as illustrated in FIG. 7B, when the third folding plate 63 moves to the front side, the third folding plate 63 pushes the rear-side stretch film F toward the underside of the article to be packaged W. At this time, the peripheral edge portion of the rear-side stretch film F continues to be held by the second feeder unit 52. Then, as illustrated in FIG. 8A, when the third folding plate 63 further moves to the front side, the third folding plate 63 pushes the rear-side stretch film F into a portion between the article to be packaged W and the lifter mechanism 20. The rear-side stretch film F wraps the article to be packaged W on the upper side of the third folding plate 63 to go along the external shape of the article to be packaged W on the rear side.

Thereafter, holding of the peripheral edge portion of the rear-side stretch film F by the second feeder unit 52 is released. Since holding of the peripheral edge portion of the rear-side stretch film F by the second feeder unit 52 is released, the rear tension decreases, and a force that causes the article to be packaged W to be pulled to the rear side by the stretch film F decreases. In accordance with the release of the holding, the peripheral edge portion of the rear-side stretch film F is folded into the underside of the article to be packaged W to wrap around the third folding plate 63. Meanwhile, the peripheral edge portions of the right-side and left-side stretch films F are folded into the underside of the tray T as the first folding plate 61 and the second folding plate 62 move horizontally to the underside of the tray T in an appropriate timing.

Presuming that the front tension is not decreased, the article to be packaged W is pulled to the front side by the stretch film F, and a posture change of the article to be packaged W is easy to be generated, such as the rear side of the article to be packaged W rising. In particular, in a case in which the article to be packaged W is the commodity G placed on the tray T, and in which the weighted center P of the commodity G is located at a region to the front with respect to the center C of the tray T or a region above the height of the tray T, the rear side of the article to be packaged W is particularly easy to rise. In this state, when the article to be packaged W is pushed from the rear side to the front side by the discharge pusher 65, the article to be packaged W may fall down at the time of discharge. When the article to be packaged W falls down, a failure of label sticking, damage of the commodity G, and the like may occur, and appropriate packaging may not be performed.

Figure 8B:
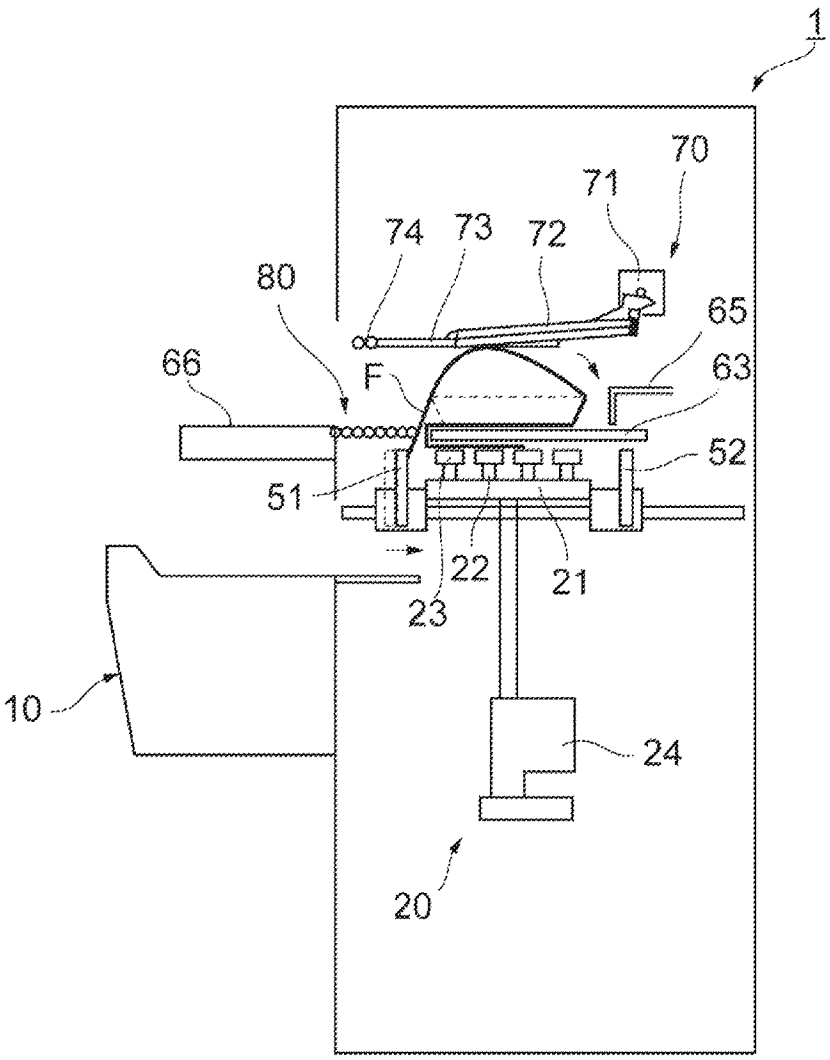
FIG. 8B is a view illustrating operation of the packaging apparatus.
Figure 8A:
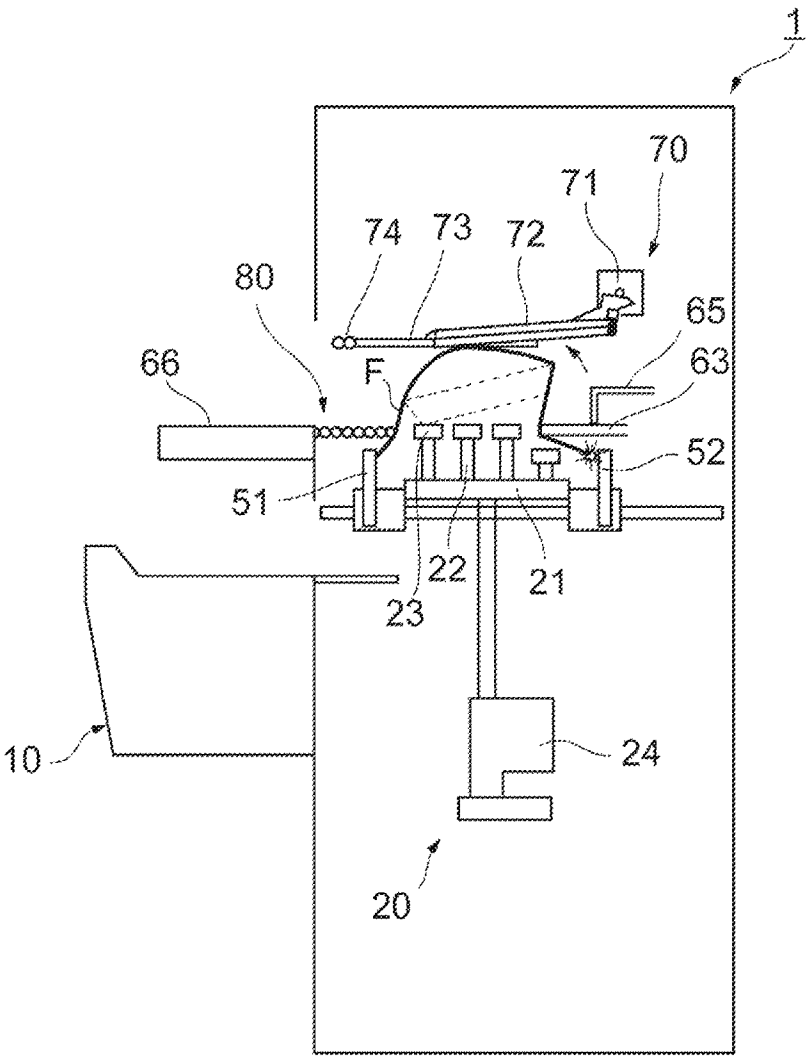
FIG. 8A is a view illustrating operation of the packaging apparatus.

Under such circumstances, in the packaging apparatus 1, as illustrated in FIG. 8B, the first feeder unit 51 is moved to approach the article to be packaged W while the front-side stretch film F continues to be held by the first feeder unit 51, thus to decrease the front tension. That is, the first feeder unit 51 is moved to decrease the tension (front tension) of the stretch film F held by the first feeder unit 51 after the peripheral edge portion of the rear-side stretch film F starts to be folded into the underside of the article to be packaged W by the third folding plate 63 before the discharge pusher 65 starts to extrude the article to be packaged W from the rear side to the front side. Here, the first feeder unit 51 is moved to the rear side. This prevents the article to be packaged W from being pushed from the rear side toward the front side by the discharge pusher 65 in a state in which the article to be packaged W is pulled to the front side by the stretch film F, and a posture change of the article to be packaged W is suppressed, such as the rear side of the article to be packaged W rising.

Meanwhile, when the third folding plate 63 finishes folding the peripheral edge portion of the rear-side stretch film F into the underside of the article to be packaged W and stops (finishes moving), the first feeder unit 51 may be moving to the rear side. In this case, the first feeder unit 51 is thereafter stopped. Alternatively, at the same time as stop of movement of the third folding plate 63, the first feeder unit 51 may finish moving to the rear side. Here, the first feeder unit 51 finishes moving to the rear side at the same time as stop of movement of the third folding plate 63. Also, the discharge pusher 65 is moved to the front side to approach the article to be packaged W so that the discharge pusher 65 may not contact the article to be packaged W before the front tension is decreased by movement of the first feeder unit 51 to the rear side.

Figure 9B:
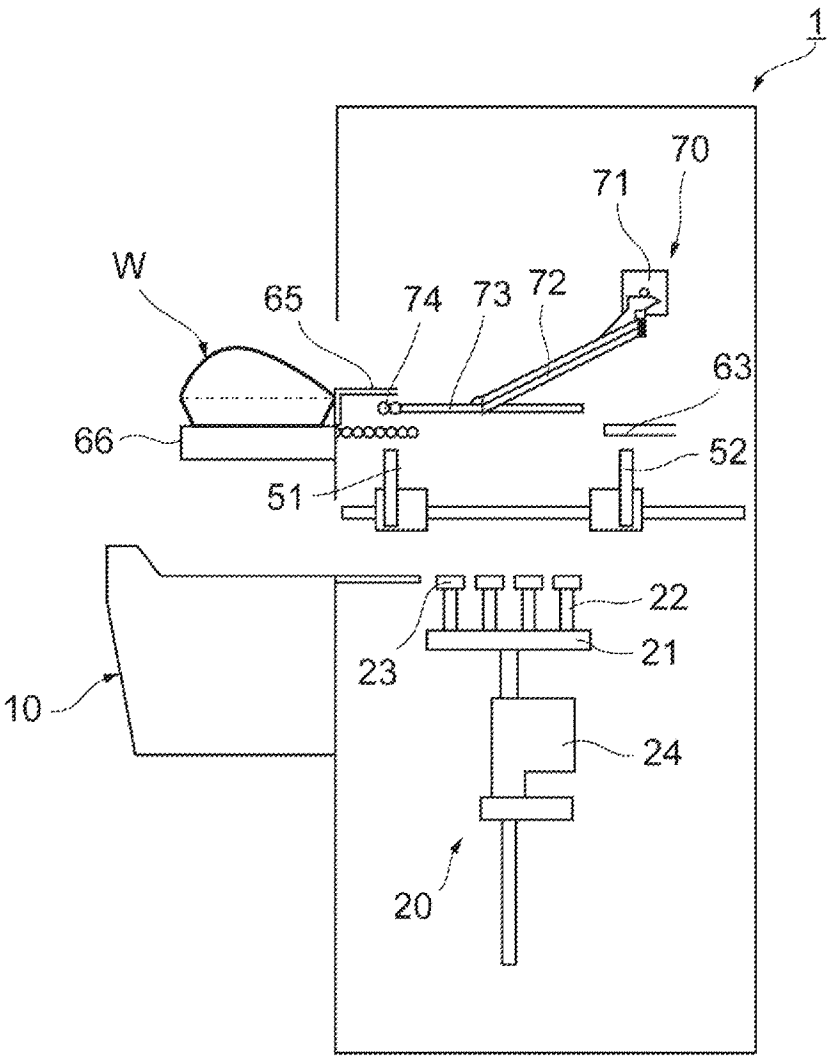
FIG. 9B is a view illustrating operation of the packaging apparatus.
Figure 9A:
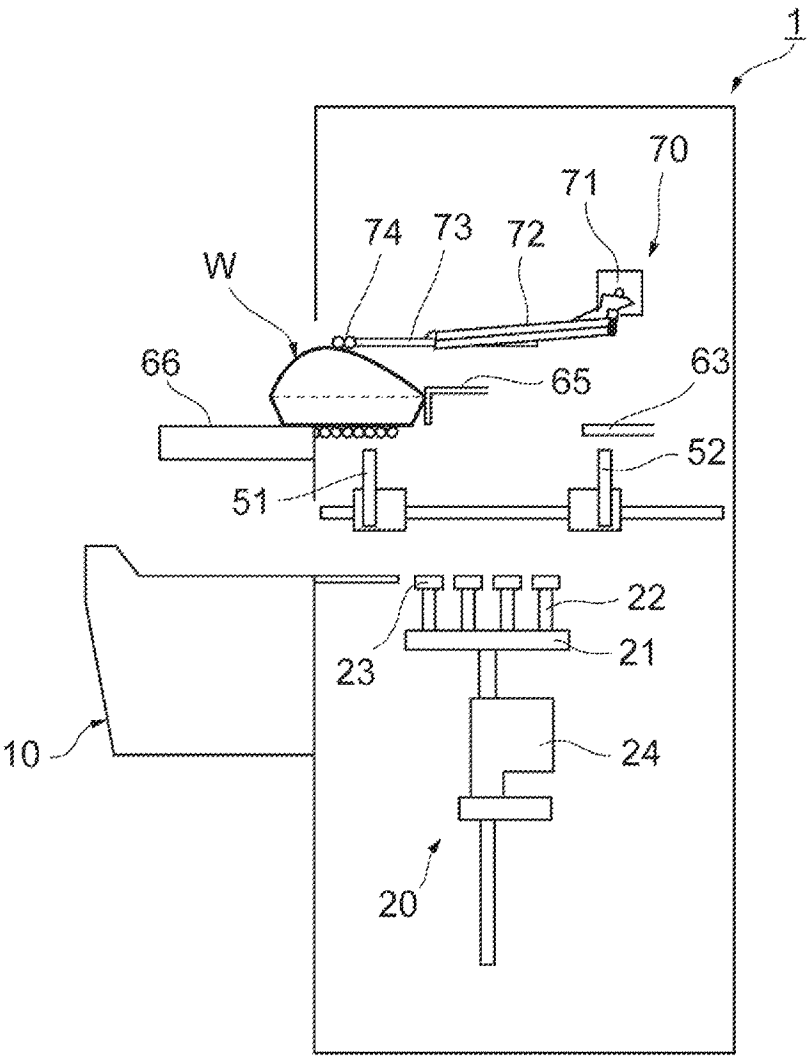
FIG. 9A is a view illustrating operation of the packaging apparatus.

Subsequently, as illustrated in FIG. 9A, the discharge pusher 65 extrudes the article to be packaged W to the front side after the front tension is decreased to discharge the article to be packaged W. When the discharge pusher 65 extrudes the tray T to a side of the discharge table 66, one side of the stretch film F on the front side that has not been folded abuts the folding rod 64. As the tray T moves to the side of the discharge table 66, the side of the stretch film F is folded into the underside of the tray T. At this time, the clamp on the front side releases the holding of the stretch film F. Furthermore, during this movement of the article to be packaged W, the stretch film F that is folded into the underside of the tray T is heat-sealed. Thereafter, as illustrated in FIG. 9B, when the article to be packaged W is discharged to the discharge table 66, the whole commodity G and the tray T are covered by the stretch film F, coming into a packaging completed state.

[Effect]

As described above, in the packaging apparatus 1, the first feeder unit 51 moves to decrease the tension of the held stretch film F after the peripheral edge portion of the rear-side stretch film F starts to be folded into the underside of the article to be packaged W by the third folding plate 63 before the discharge pusher 65 starts to extrude the article to be packaged W from the rear side to the front side. This prevents the article to be packaged W from being pushed from the rear side toward the front side by the discharge pusher 65 in a state in which the article to be packaged W is pulled to the front side by the stretch film F. Consequently, a posture change of the article to be packaged W is suppressed, such as the rear side of the article to be packaged W rising, and the article to be packaged W can be packaged in an appropriate manner.

In the packaging apparatus 1, the article to be packaged W is the commodity G placed on the tray T. The weighted center P of the commodity G is located at the region to the front with respect to the center C of the tray T and above the height of the tray T. According to this packaging apparatus 1, even in a case in which the article to be packaged W is one whose rear side is particularly easy to rise, such a posture change of the article to be packaged W can be suppressed.

In the packaging apparatus 1, the first feeder unit 51 is moved to the rear side after the peripheral edge portion of the rear-side stretch film F starts to be folded into the underside of the article to be packaged W by the third folding plate 63 before the discharge pusher 65 starts to extrude the article to be packaged W from the rear side to the front side. Accordingly, the first feeder unit 51 moves to the rear side and approaches the article to be packaged W to enable the tension of the stretch film F held by the first feeder unit 51 to be decreased easily and reliably.

Modification Examples

Although one embodiment of the present invention has been described above, the present invention is not limited to the above-described embodiment. For example, although the first feeder unit 51 is moved to the rear side to decrease the front tension, the direction in which the first feeder unit 51 is moved to approach the article to be packaged W is not limited to the rear side. For example, the front tension may be decreased by supporting the first feeder unit 51 to enable the first feeder unit 51 to move along the vertical direction of the packaging apparatus 1, as well as or instead of the back and forth direction of the packaging apparatus 1, and by moving the first feeder unit 51 to the upper side. Meanwhile, the movement of the first feeder unit 51 includes a posture change of the first feeder unit 51 such as tilting of the first feeder unit 51, causing the tension of the held stretch film F to decrease.

Also, in the above-described embodiment, although the weighted center P of the commodity G is located at the region to the front with respect to the center C of the tray T and above the height of the tray T, the weighted center P of the commodity G may be located at a region to the front with respect to the center C of the tray T and below the height of the tray T, or the weighted center P of the commodity G may be located at a region to the rear with respect to the center C of the tray T and above the height of the tray T. Also, in the above-described embodiment, the article to be packaged W is the commodity G placed on the tray T. However, in a case in which the commodity G is packaged in a state of not being placed on the tray T, the weighted center P of the commodity G may be located at a region to the rear with respect to a center of the commodity G or a region above the center of the commodity G. In the case in which the weighted center P of the commodity G is located at such a region, the rear side of the article to be packaged W is similarly easy to rise. For this reason, by applying one aspect of the present invention, the effect of suppressing a posture change of the article to be packaged is exerted effectively.

Further, in the above-described embodiment, although an example that the first feeder unit 51 is moved to decrease the front tension in a case the article to be packaged W, whose rear side is easy to rise, is packaged in the packaging apparatus 1, has been described, the first feeder unit 51 does not necessarily move to decrease the front tension. For example, unlike the article to be packaged W, in a case in which an article to be packaged whose rear side is difficult to rise is packaged in the packaging apparatus 1, the movement of the first feeder unit 51 may be omitted.

REFERENCE SIGNS LIST

1 packaging apparatus
20 lifter mechanism (lifting unit)
51 first feeder unit (first holding unit)
52 second feeder unit (second holding unit)
63 third folding plate (folding unit)
65 discharge pusher (extruding unit)
W article to be packaged
F stretch film (film)
G commodity
P weighted center
T tray

The invention claimed is:

1. A packaging apparatus for packaging an article to be packaged by covering the article to be packaged with a film held at a peripheral edge portion thereof and stretched and overlapping the peripheral edge portion of the film below the article to be packaged, the packaging apparatus comprising:

a first film edge holder configured to hold the peripheral edge portion of the film on a front side;

a second film edge holder provided to be opposed to the first film edge holder and configured to hold the peripheral edge portion of the film on a rear side;

an article lifter configured to carry the article to be packaged and press the article to be packaged to the film held and stretched by the first film edge holder and the second film edge holder;

a film folder configured to fold the peripheral edge portion of the film on the rear side to which the article to be packaged has been pressed by the article lifter into an underside of the article to be packaged; and an article extruder configured to extrude to the front side the article to be packaged having the peripheral edge portion of the film on the rear side folded under the article to be packaged by the film folder, wherein the first film edge holder moves from the front side to the rear side to decrease tension of the film held after the peripheral edge portion of the film on the rear side starts to be folded into the underside of the article to be packaged by the film folder before the article extruder starts to extrude the article to be packaged from the rear side to the front side, and the second film edge holder is configured to release the film before the film is finished being folded into the underside of the article to be packaged.

2. The packaging apparatus according to claim 1, wherein the packaging apparatus is configured to package the article to be packaged that is a commodity placed on a tray having a center of gravity located at a region to the front side with respect to a center of the tray or a region above a height of the tray.

3. The packaging apparatus according to claim 1, wherein the first film edge holder moves to the rear side after the peripheral edge portion of the film on the rear side starts to be folded into the underside of the article to be packaged by the film folder before the article extruder starts to extrude the article to be packaged from the rear side to the front side.

4. The packaging apparatus according to claim 2, wherein the first film edge holder moves to the rear side after the peripheral edge portion of the film on the rear side starts to be folded into the underside of the article to be packaged by the film folder before the article extruder starts to extrude the article to be packaged from the rear side to the front side.

* * * * *